United States Patent [19]

Guerre

[11] 4,348,274

[45] * Sep. 7, 1982

[54] OIL SHALE UPGRADING PROCESS

[75] Inventor: Robert P. Guerre, Seabrook, Tex.

[73] Assignee: Exxon Research & Engineering Co., Florham Park, N.J.

[ * ] Notice: The portion of the term of this patent subsequent to Jul. 6, 1999, has been disclaimed.

[21] Appl. No.: 220,205

[22] Filed: Dec. 24, 1980

Related U.S. Application Data

[63] Continuation-in-part of Ser. No. 57,250, Jul. 13, 1979.

[51] Int. Cl.[3] ..... B03B 9/02

[52] U.S. Cl. ..... 209/2; 209/17; 209/172.5; 208/11 R; 208/11 LE; 241/24; 241/77

[58] Field of Search ..... 209/12, 155, 156–158, 209/173, 2, 3, 133–139 R, 454, 455, 464, 11, 17, 172, 172.5; 241/20, 24, 77; 208/11 R, 11 LE

[56] References Cited

U.S. PATENT DOCUMENTS

| | | | |
|---|---|---|---|
| Re. 11,334 | 5/1893 | Luhrig | 209/2 |
| 2,150,917 | 3/1939 | Foulke | 209/172 |
| 2,217,286 | 10/1940 | McNulty | 241/77 X |
| 2,422,203 | 6/1947 | NcNeil | 209/21 X |
| 2,612,267 | 9/1952 | Vogel | 209/156 X |
| 2,675,966 | 4/1954 | Nihlstelt | 41/77 X |
| 2,754,963 | 7/1956 | Kriggsman | 209/172.5 X |
| 2,842,319 | 7/1958 | Reerink | 209/2 X |
| 2,890,795 | 6/1959 | Dering | 209/12 |
| 3,151,175 | 3/1939 | Wvensch | 209/172.5 |
| 3,193,741 | 7/1905 | Holowaty | 209/172.5 |
| 3,252,769 | 5/1966 | Nugelwit | 214/1 |
| 3,261,559 | 7/1966 | Yavorsky | 209/158 X |
| 3,908,912 | 9/1975 | Irons et al. | 241/24 X |
| 3,973,734 | 8/1976 | Rosar | 209/166 |
| 4,044,695 | 8/1977 | Mackenzie | 110/222 X |
| 4,155,313 | 5/1979 | Moss | 110/106 |

FOREIGN PATENT DOCUMENTS

| | | | |
|---|---|---|---|
| 224951 | 4/1957 | Australia | 209/172.5 |
| 1157172 | 11/1963 | Fed. Rep. of Germany | 209/172.5 |
| 322480 | 12/1929 | United Kingdom | 209/2 |
| 486771 | 6/1938 | United Kingdom | 209/172.5 |
| 856636 | 12/1960 | United Kingdom | 209/172.55 |
| 1262722 | 2/1972 | United Kingdom | 110/222 |

OTHER PUBLICATIONS

Coal Mining & Processing, Chem. Comminution, An Improved Route to Clean Coal, Quackerbush et al., 5/1979.

*Primary Examiner*—Ralph J. Hill
*Attorney, Agent, or Firm*—Yale S. Finkle

[57] ABSTRACT

A size fraction of oil shale is upgraded by separating the shale into a first low density fraction containing particles relatively rich in kerogen and a first high density fraction containing particles relatively lean in kerogen, crushing the first low density fraction to produce smaller particles, separating the smaller particles into a second low density fraction and a second high density fraction and recovering the second low density fraction as high grade oil shale rich in kerogen.

9 Claims, 1 Drawing Figure

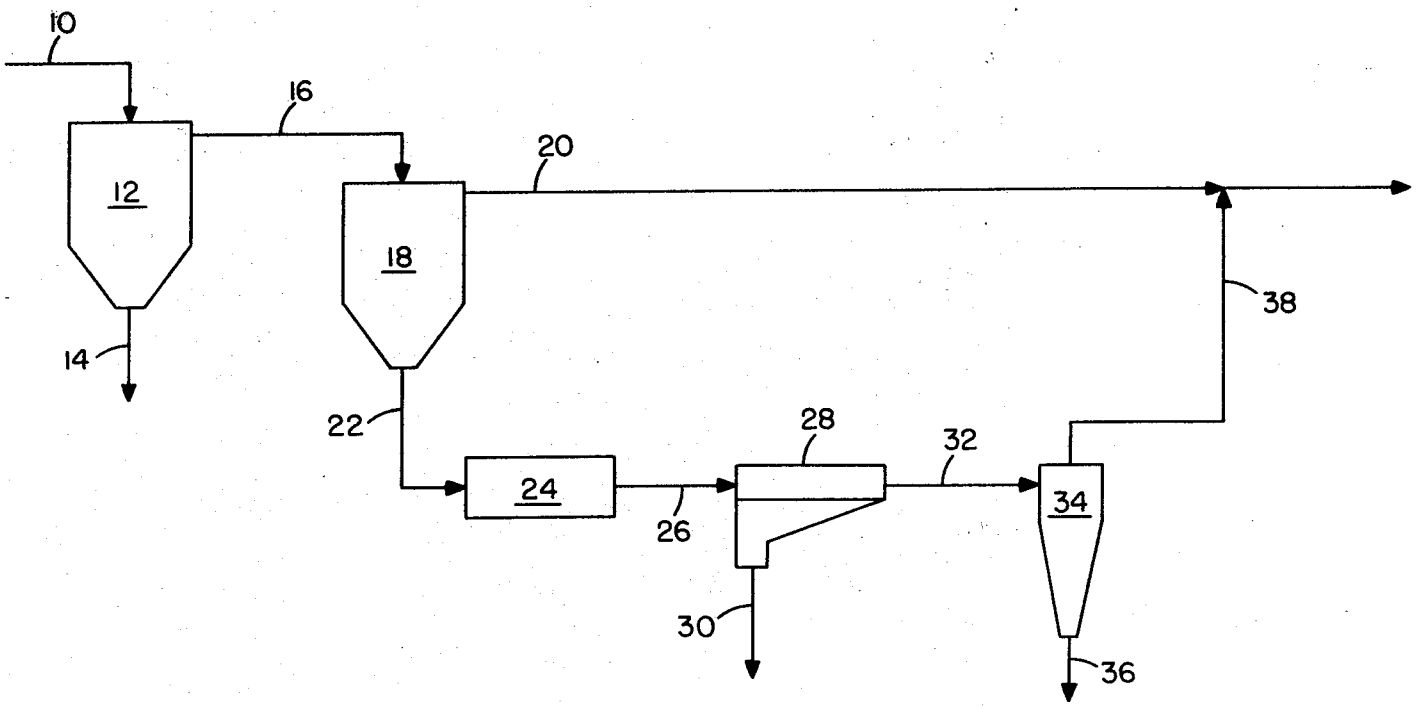
10
12
14
16
18
20
22
24
26
28
30
32
34
36
38

OIL SHALE UPGRADING PROCESS

CROSS-REFERENCE TO RELATED APPLICATIONS

This application is a continuation-in-part of application Ser. No. 57,250, filed in the United States Patent and Trademark Office on July 13, 1979.

BACKGROUND OF THE INVENTION

This invention relates to a process for the upgrading or beneficiation of oil shale and is particularly concerned with upgrading raw oil shale by physically removing a substantial portion of the lower grade shale particles.

Oil shale is a sedimentary rock having a predominately fine-grain structure containing a hydrocarbon material referred to as kerogen, a solid organic material of a high molecular weight which is insoluble in conventional organic solvents. Normally, oil shale will contain between about 5 and about 35 weight percent kerogen. Upon heating, a portion of the kerogen decomposes to produce a hydrocarbon liquid and gaseous product. The liquid hydrocarbon product is referred to as shale oil. Normally, the kerogen is recovered in the form of shale oil from oil shale by pyrolyzing or retorting the shale at high temperatures, generally temperatures between 900° F. and 1100° F. Since the kerogen content of oil shale is relatively low, large amounts of the shale must be retorted in order to recover significant amounts of shale oil. When the shale is subjected to such high temperatures it leaves behind an ash-like residue containing residual carbon which must be disposed of. Beacuse of the low yield of shale oil and the high yield of residue, it is desirable to upgrade the oil shale prior to pyrolysis or retorting by removing the lower grade shale particles which contain only small quantities of kerogen.

The particle density of oil shale is inversely proportional to the amount of kerogen content and it has been suggested that oil shale can be separated into low grade and high grade fractions by the use of the sink/float technique, which is commonly referred to as a gravimetric separation. The resultant low density fraction will be comprised of high grade particles of shale which will contain substantially more kerogen than the particles comprising the low grade fraction and therefore can be selectively processed for the recovery of the kerogen in the form of shale oil. Although such an upgrading process will increase the yield of oil shale and decrease the amount of residue produced during retorting, there is still room for substantial improvement in upgrading the oil shale to increase the yield of liquid hydrocarbons and decrease the production of inorganic residue materials.

SUMMARY OF THE INVENTION

The present invention provides an improved process for upgrading or beneficiating oil shale. In accordance with the invention it has now been found that increased amounts of high grade or kerogen-rich oil shale can be effectively recovered from raw shale by separating the shale into a first low density fraction containing a relatively large amount of kerogen and a first high density fraction containing a relatively small amount of kerogen, reducing the size of at least a portion of the particles comprising the first low density fraction to produce smaller particles, separating these smaller particles into a second low density fraction containing a relatively large amount of kerogen and a second high density fraction containing a relatively small amount of kerogen, and recovering the second low density fraction as a product of high grade oil shale.

Since inorganic material comprises the predominant constituents by weight of oil shale and since such inorganic material varies widely in composition depending upon the origin of the oil shale, the kerogen-rich particles comprising shales from different formations and geographical locations will tend to have widely varying densities. Thus the specific gravities of the particles comprising the first low and high density fractions produced in the initial separation step of the process of the invention will depend on the type of raw shale being upgraded. For example, if oil shale from the Green River formation in Colorado is being upgraded, the initial separation step will normally be conducted in such a manner that the first high density fraction will contain particles having specific gravities greater than a value in the range from about 2.0 to about 2.4, preferably in the range from about 2.1 to about 2.3, and therefore the first low density fraction will contain particles having specific gravities less than such a value. If, on the other hand, the oil shale being upgraded is run-of-mine shale from the Rundle formation in Australia, the initial separation step will normally be conducted in such a manner that the first high density fraction will be comprised of particles having specific gravities greater than a value in the range from about 1.7 to about 2.1, preferably greater than a value of about 1.9. The resulting first low density fraction will then contain particles having specific gravities less than such a value.

In a preferred embodiment of the invention the initial low density fraction of oil shale produced as described above is further separated into a lower density fraction and a middle density fraction prior to the size reduction step. The lower density fraction will normally be composed of particles so rich in kerogen and they can normally be directly recovered as high grade shale. The middle density fraction is then subjected to the size reduction step and the resultant particles separated into a high density fraction and a second low density fraction that is recovered as high grade oil shale.

The process of the invention is based at least in part upon the discovery that when an oil shale fraction comprised of particles having specific gravities higher than a predetermined value is crushed and subjected to a gravimetric separation, the resulting low density fraction will be leaner or contain a lesser amount of kerogen than a similar low density fraction produced by crushing an oil shale fraction comprised of particles richer in kerogen having specific gravities lower than the predetermined value and subjecting the resultant particles to the same gravimetric separation. Thus, in a simple, one-step oil shale upgrading process where all of the oil shale is crushed, the resultant particles are subjected to a gravimetric separation and the low density fraction is recovered as product, this low density fraction will contain less kerogen than would be the case if the leaner particles of high specific gravity in the original oil shale were removed prior to the crushing step. The process of the invention produces a higher grade product because the leaner particles of high specific gravity are removed from the oil shale prior to the crushing step which then operates on a lower density, higher grade fraction of oil shale.

The process of the invention provides a method for physically upgrading oil shale which results in the removal of greater amounts of low grade shale particles from the raw oil shale than is normally possible by utilizing other oil shale upgrading techniques. Thus, the process of the invention can be used to produce high grade shale containing kerogen which can be recovered by retorting without the production of excessive amounts of inorganic residue materials.

BRIEF DESCRIPTION OF THE DRAWING

The drawing is a schematic flow diagram of an oil shale upgrading process carried out in accordance with the invention.

DESCRIPTION OF THE PREFERRED EMBODIMENTS

The process depicted in the drawing is one for the upgrading or beneficiation of a fraction of oil shale having a top size from 2 to 4 inches and prepared by crushing run-of-mine shale from the Green River formation in Colorado. It will be understood that the feed to the upgrading process is not restricted to this particular size fraction of crushed run-of-mine oil shale or to this particular type of shale and instead can be any size fraction of any type of oil shale.

In the process depicted in the drawing, the oil shale is passed through line 10 into heavy medium washing vessel or similar device 12 where the particles are mixed with a heavy medium consisting of a sufficient amount of finely ground magnetite suspended in water to give a predetermined specific gravity which will normally range from about 2.0 to about 2.4, preferably from about 2.1 to about 2.3. The actual specific gravity utilized will normally depend upon the type of oil shale fed to the washing vessel. The particles entering the vessel that have a specific gravity higher than the specific gravity of the aqueous magnetite suspension sink to the bottom of the vessel and the feed particles having a specific gravity lower than that of the suspension rise to the top of the vessel. High density particles near the bottom of the vessel are low grade oil shale particles containing a relatively small amount of kerogen. These low grade or kerogen-lean particles are withdrawn from the bottom of vessel 12 through line 14 and may be used for landfill, further processed, or employed in other applications.

It will be understood that in lieu of the heavy medium washing vessel shown in the drawing, other vessels or similar equipment in which gravimetric separations can be carried out may be utilized depending upon the size fraction of the particles fed to the vessel. For example, if a fraction of relatively large particles is being processed, a jig may be used to effect the gravimetric separation. If an intermediate size fraction containing particles from about 1 inch to about $\frac{1}{4}$ inch top size down to from about 30 mesh to 100 mesh on the U.S. Sieve Series Scale is used, cyclones and/or concentrating tables may be used to effect the separation. Such pieces of equipment are described in the literature and will therefore be familiar to those of ordinary skill in the art.

In oil shale retorting processes, the oil shale is crushed, sized and then directly retorted. The amount of hydrocarbon oil recovered in these retorting process is limited by the relatively small amount of kerogen in the raw oil shale. Thus, to obtain high yields of liquids, large amounts of oil shale must be retorted thereby resulting in the production of large amounts of inorganic residues. It has now been found that oil shale can be upgraded prior to retorting so that the feed to the retort will contain much greater concentrations of kerogen and the amount of shale needed to produce high yields of liquid will be substantially reduced. The upgrading process consists of subjecting the oil shale to a gravimetric separation to remove the low grade particles of shale which contain relatively small amounts of kerogen and then selectively crushing the lower density particles which are much richer in kerogen. The low density fraction of particles obtained by subjecting the crushed oil shale to a second gravimetric separation will contain more kerogen than a similar fraction obtained from a process which does not utilize a separation step prior to crushing.

The process of the invention is based at least in part upon the discovery that if a fraction of low grade oil shale particles is crushed and subsequently subjected to a gravimetric separation, the resultant low density fraction is leaner in kerogen than a low density fraction obtained by crushing a higher grade fraction of oil shale and subjecting it to a gravimetric separation at the same specific gravity. Thus, when a fraction of run-of-mine oil shale containing low grade and high grade particles is crushed, the smaller, low density particles that are produced by crushing the kerogen-lean particles will be lower grade than the smaller, low density particles produced by crushing the kerogen-rich particles. Since some of these low density particles will be in the same specific gravity range, they will commingle with one another when the crushed oil shale is separated into a low density and high density fraction. This commingling of kerogen-lean and kerogen-rich particles is avoided by initially rejecting the low grade particles from the oil shale feed prior to crushing.

Referring again to the drawing, the low density, higher grade fraction of oil shale rich in kerogen produced in washing vessel 12 by removing the lower grade, higher density particles lean in kerogen is withdrawn and passed through line 16 into a second heavy medium washing vessel 18 where the particles of shale are subjected to another gravimetric separation at a specific gravity less than that utilized in washing vessel 12 in order to recover kerogen-rich particles. Normally, the specific gravity in washing vessel 18 will range from about 1.8 to about 2.0, and will preferably be about 1.9. The low density particles that float to the top of washing vessel 18 will contain relatively large amounts of kerogen and may be withdrawn from the washing vessel through line 20 and recovered for direct use as a feed to a pyrolysis or retorting process. The higher density particles that settle to the bottom of washing vessel 18 are removed from the vessel through line 22. These particles tend to be relatively lean in kerogen and are further treated so as to produce an overall fraction of particles that is rich in kerogen.

The high density particles in line 22 are passed to rotary crusher or similar fragmenting device 24 where the oil shale particles are ground, crushed, or otherwise reduced in size to liberate particles richer in kerogen from the lower grade particles of shale which contain relatively small amounts of kerogen. The greater the degree of crushing or grinding the more of the kerogen-rich particles that are liberated. It is, however, undesirable to crush or grind to very small particle sizes since this requires a relatively large input of energy and makes the subsequent separation difficult to achieve. The actual size of the particles produced in the rotary crusher is determined in part by balancing the cost of the crushing with the amount of kerogen-rich particles liberated and the fineness of the resultant product. Each individual particle of a particular specific gravity that is crushed in rotary crusher 24 is converted into smaller particles having a wide spectrum of specific gravities, including specific gravities greater than, equal to and less than the specific gravity of the original particle.

The crushed oil shale removed from rotary crusher 24 will normally have a top size between about 1 inch and about ¼ inch and is passed through line 26 to vibrating screen or similar size separation device 28 where the fine particles, normally those below about 30 mesh to about 100 mesh in size are separated from the coarser particles and withdrawn through line 30. If the particles in line 30 are relatively high grade, kerogen-rich particles, they may be combined with the particles in line 20 and used directly as feed to an oil shale pyrolysis or retorting process.

The coarse fraction of particles produced by separation in vibrating screen 28 is passed through line 32 to heavy medium cleaning cyclone 34 where the particles are subjected to a gravimetric separation to separate the kerogen-lean particles from the high grade, kerogen-rich particles. The specific gravity of the aqueous magnetite suspension used as the heavy medium in cyclone 34 will normally range from about 2.0 to about 2.4 and will preferably be about equal to the specific gravity of the suspension used in washing vessel 12. The heavier particles that are forced to the bottom of cyclone 34 are withdrawn through line 36 and disposed of as landfill, further processed, or used for other purposes. The particles of oil shale that rise to the top of the vessel contain relatively small amounts of inorganic constituents and are rich in kerogen. These high grade oil shale solids are removed from the vessel through line 38 and may be combined with the solids removed from washing vessel 18 through line 20 and used as feed to an oil shale retorting or pyrolysis process.

The actual specific gravities at which the separations in vessels 12, 18 and 34 of the embodiment of the invention described above are carried out will depend on the type of oil shale being processed. The numerical values of the specific gravities set forth above for these separations are based on the oil shale being from the Green River formation in Colorado. If the shale being processed is a different type, the actual specific gravities for these separations will have to be ascertained by determining the kerogen content of varying specific gravity fractions of the shale so that the kerogen-rich and kerogen-lean fractions can be characterized. For example, the kerogen-lean fraction of an oil shale from the Rundle formation in Austrailia was found to contain particles having specific gravities greater than a value in the range from about 1.7 to about 2.1, preferably greater than about 1.9. Thus, if such a shale was being processed, the separation in vessel 12 would be carried out at a specific gravity from about 1.7 to about 2.1, preferably at about 1.9. Similarly, the kerogen-rich fraction of Rundle shale was found to contain particles having specific gravities less than a value in the range from about 1.6 to about 1.8 and therefore the separation in vessel 18 would be carried out at a specific gravity from about 1.6 to about 1.8 when processing such a shale. The specific gravity utilized in vessel 34 will normally be in the same range as that utilized in vessel 12 regardless of the type of shale being processed.

In the embodiment of the invention shown in the drawing and described above, particles of oil shale are subjected to a first gravimetric separation in washing vessel 12 at a relatively high specific gravity and a second gravimetric separation in washing vessel 18 at a lower specific gravity. The purpose of these separations is to divide the oil shale into three weight fractions: a low density fraction in line 20 which is normally recovered as high grade oil shale, a high density fraction in line 14 which is normally rejected as low grade oil shale, and a middle density fraction in line 22 which is crushed to form particles of shale which are richer in kerogen than the particles fed to the crushing step. It will be understood that this embodiment of the invention is not limited to this particular configuration for producing the three fractions of different densities. For example, it may be desirable to use a lower specific gravity in the first vessel than in the second washing vessel. If such is the case, the lower density fraction is recovered from the top of vessel 12, the bottoms from the vessel is fed to vessel 18, the bottoms from vessel 18 is rejected as low grade oil shale and the overhead from vessel 18 comprises the middle density fraction that is subjected to crushing. Alternatively, a single washing vessel containing two magnetite suspensions or other fluid media of different specific gravities or a cleaning device such as a concentrating table can be used to produce the three weight fractions in a single step.

It will be further understood that the process of the invention is not limited to the embodiment where the oil shale is divided into three weight fractions and the middle density fraction is crushed and subjected to a gravimetric separation. The process of the invention is equally applicable to the case where the oil shale is subjected to a single separation and the resultant low density fraction is crushed and separated. In addition, the process of the invention is applicable to the situation where more than two separations are utilized prior to the crushing and subsequent separation step.

It will be apparent from the foregoing that the process of the invention provides a method for upgrading oil shale which makes it possible to obtain high grade shale containing relatively large amounts of kerogen from run-of-mine oil shale. By using such high grade shale as a feed to a pyrolysis or retorting process, it is possible to produce a much larger yield of hydrocarbon oil from the same amount of feed material than would be possible if run-of-mine oil shale were utilized.

I claim:

1. A process for upgrading particulate oil shale which comprises:

(a) removing substantially all particles having a specific gravity greater than a predetermined value from said oil shale thereby producing a first low density fraction of particles;

(b) crushing or grinding substantially all of said particles comprising said first low density fraction to produce smaller particles;

(c) separating said smaller particles into a high density fraction and a second low density fraction; and (d) recovering said second low density fraction as high grade oil shale rich in kerogen.

2. A process as defined in claim 1 wherein steps (a) and (c) comprise gravimetric separations.

3. A process as defined in claim 1 wherein said oil shale is from the Green River formation in Colorado and step (a) is a gravimetric separation carried out at a specific gravity in the range from about 2.0 to about 2.4.

4. A process as defined in claim 1 wherein kerogen-rich particles having a specific gravity less than a predetermined value in the range between about 1.7 and about 2.4 are removed from said oil shale prior to step (a) and recovered as high grade oil shale.

5. A process as defined in claim 1 wherein the particles comprising said first low density fraction are reduced in size to smaller particles having a top size between about 1 inch and about ¼ inch.

6. A process for upgrading oil shale which comprises:

(a) subjecting said oil shale to a gravimetric separation at a predetermined specific gravity to divide said oil shale into a first high density fraction and a lighter density fraction;

(b) subjecting substantially all of said lighter density fraction to a gravimetric separation at a specific gravity less than said predetermined specific gravity to divide said lighter density fraction into a low density fraction and a middle density fraction comprised of particles;

(c) crushing or grinding the particles comprising said middle density fraction to produce smaller particles;

(d) subjecting said smaller particles to a gravimetric separation at a specific gravity greater than said specific gravity used in step (b), thereby producing a second low density fraction and a second high density fraction; and (e) recovering said second low density fraction as high grade oil shale rich in kerogen.

7. A process for upgrading oil shale from the Green River formation in Colorado which comprises:

(a) subjecting said oil shale to a gravimetric separation carried out at a specific gravity from about 2.0 to about 2.4, thereby separating said oil shale into a first low density fraction and a first high density fraction;

(b) subjecting said first low density fraction to a gravimetric separation carried out at a specific gravity from about 1.8 to about 2.0, thereby producing a second low density fraction and a second high density fraction comprised of particles;

(c) crushing the particles comprising said second high density fraction thereby producing smaller particles including particles having a specific gravity greater than the specific gravity at which the gravimetric separation of step (a) is carried out;

(d) subjecting at least a portion of said smaller particles produced in step (c) to a gravimetric separation carried out at a specific gravity from about 2.0 to about 2.4, thereby producing a third low density fraction and a third high density fraction; and (e) recovering said third low density fraction as high grade oil shale rich in kerogen.

8. A process as defined in claim 7 wherein the gravimetric separation of step (a) is carried out at a specific gravity from about 2.1 to about 2.3, the gravimetric separation of step (b) is carried out at a specific gravity of about 1.9 and the gravimetric separation of step (d) is carried out at about the same specific gravity utilized in step (a).

9. A process for upgrading oil shale which comprises:

(a) subjecting said oil shale to a gravimetric separation at a predetermined specific gravity to divide said oil shale into a first low density fraction and a heavier density fraction;

(b) subjecting said heavier density fraction to a gravimetric separation at a specific gravity greater than said predetermined specific gravity to divide said heavier density fraction into a first high density fraction and a middle density fraction comprised of particles;

(c) crushing or grinding said particles comprising said middle density fraction to produce smaller particles;

(d) subjecting said smaller particles to a gravimetric separation at a specific gravity greater than said predetermined specific gravity used in step (a), thereby producing a second high density fraction and a second low density fraction; and (e) recovering said second low density fraction as high grade oil shale rich in kerogen.

* * * * *